US007520830B2

(12) United States Patent
Wong

(10) Patent No.: US 7,520,830 B2
(45) **Date of Patent: *Apr. 21, 2009**

(54) GAME BALL

(76) Inventor: Jacob Y. Wong, 7110 Georgetown Rd., Goleta, CA (US) 93117

( * ) Notice: Subject to any disclaimer, the term of this patent is extended or adjusted under 35 U.S.C. 154(b) by 0 days.

This patent is subject to a terminal disclaimer.

(21) Appl. No.: 11/478,955

(22) Filed: Jun. 29, 2006

(65) Prior Publication Data

US 2007/0037641 A1 Feb. 15, 2007

Related U.S. Application Data

(60) Provisional application No. 60/707,695, filed on Aug. 11, 2005.

(51) Int. Cl.
*A63B 43/04* (2006.01)

(52) U.S. Cl. ..... 473/594; 473/595

(58) Field of Classification Search ..... 473/570, 473/571, 594, 595

See application file for complete search history.

(56) References Cited

U.S. PATENT DOCUMENTS

| | | | | | |
|---|---|---|---|---|---|
| 495,863 | A * | 4/1893 | Whitzel | 473/571 |
| 1,120,757 | A * | 12/1914 | Steinberger | 473/594 |
| 2,020,484 | A * | 11/1935 | Turner | 473/570 |
| 3,395,462 | A * | 8/1968 | Sebree | 473/571 |
| 3,655,197 | A * | 4/1972 | Milbaum | 473/594 |
| 4,194,737 | A * | 3/1980 | Farmer | 473/570 |
| 4,448,418 | A * | 5/1984 | McNeill | 473/594 |
| 4,872,676 | A * | 10/1989 | Townsend | 473/594 |
| 5,150,906 | A * | 9/1992 | Molitor et al. | 473/354 |
| 5,725,445 | A * | 3/1998 | Kennedy et al. | 573/570 |
| 6,398,616 | B1 * | 6/2002 | Motosko, III | 473/595 |
| 6,475,104 | B1 * | 11/2002 | Lutz et al. | 473/357 |

(Continued)

FOREIGN PATENT DOCUMENTS

FR 2797776 A1 * 3/2001

OTHER PUBLICATIONS http://www.thefreedictionary.com/Struts; "Struts-definition", retrieved Dec. 4, 2006.*

*Primary Examiner*—Steven Wong
(74) *Attorney, Agent, or Firm*—Roy L Anderson; Wagner, Anderson & Bright, LLP

(57) ABSTRACT

A ball with a hollow inner core filled approximately 50% or less by volume with a fluid (which can include metallic spheres), a ball shell and struts (six or more) attached to the core and connected to an inner surface of the ball in such a way so as to maintain the core at the center of the ball. A swirling motion of the fluid within the hollow inner core determines the motion of the ball and a direction of travel away from a point of contact at which a force is applied to the ball to cause it to move or change direction. The direction of travel of the ball will be to the right when a counterclockwise spin is applied to the ball at the point of contact, the direction of travel of the ball will be to the left when it a clockwise spin is applied to the ball at the point of contact, and the direction of travel of the ball will be straight when a top spin is applied to ball at the point of contact. The weight ratio of the fluid to the ball without the fluid is approximately 1:1 or greater.

20 Claims, 8 Drawing Sheets

U.S. PATENT DOCUMENTS 6,537,125 B1 * 3/2003 Motosko, III ..... 473/595
2005/0049092 A1 * 3/2005 Lo ..... 473/594
2006/0063622 A1 * 3/2006 Nurnberg et al. ..... 473/604

* cited by examiner

GAME BALL

CROSS-REFERENCE TO RELATED APPLICATIONS

The present application is a continuation-in-part application of U.S. Provisional Patent Application Ser. No. 60/707,695, entitled "The Sporting Game of Sokker Golph™," filed Aug. 11, 2005 with the same inventor, the disclosure of which is specifically incorporated herein by reference, and is related to 11/478,956 being filed concurrently herewith claiming priority from the same application with the same inventor, entitled "The Sporting Game Of Sokker Golph™." The disclosures of both of these applications are specifically incorporated herein by reference.

FIELD OF THE INVENTION

The present invention generally relates to a special kind of sporting or game ball of the hybrid air type and, more particularly, to a ball that exhibits eccentric rolling and flight characteristics unless it is kicked or putted with a concomitant application of a particular spin action which will influence to a large extent the subsequent motion of the ball.

BACKGROUND OF THE INVENTION

For over a century, the game of golf has always been considered as a game of the highest prestige and esteem. The reason is that the game of golf requires not only a player's developed skill but also one's mastery over one's mind when the game is played. In this respect golf is truly a unique game of its own unmatched by any others in the sporting field. Unfortunately for ordinary folks, golf has also been developed over the years primarily for people with means. It has been looked upon as only a rich man's game that requires not only expensive equipment to play (e.g. the golf club set and bag), but also fashionable attire and exquisite golf courses associated with country clubs accessible only to those lucky few that can afford such means. Although in recent years many more common people can afford to enjoy playing this game as equipment outlay, playing attire costs and green fees have all slowly come down from those of earlier years, golf still remains an expensive sporting game for people to play. It is of interest to note that golf today still has not been recognized and listed as a competitive sporting event in the Olympic Games. One of the reasons is that at present golf is still not considered as a game that is accessible for play by most common people.

The game of soccer has been considered for a long time by many as the most popular and beloved sporting game of the world. Only until relatively recently soccer was not a popular game in the United States, primarily because of the co-existence of the enormously popular game of American football. Over the past decade or so, the popularity of soccer in the United States has grown significantly because of the success of the American women's soccer teams in world competitions. Today soccer is just as popular, if not more so, as little league baseball for elementary school children, boys and girls alike. In the coming years it is difficult to not believe that soccer will rank equally in enthusiasm and support alongside with American football, baseball, ice hockey and basketball as the most popular seasonable sporting games in the United States.

As more and more people play golf in the United States when the overall playing cost for the game slowly declines over the years and the popularity of soccer has just about gone through the roof in about the same time span, particularly in the United States, an opportunity presents itself for introducing a game that combines the striking features of these two popular and beloved games into one that is more accessible to common people. Such a game, called "Sokker Golph™", will preserve, albeit in a different way, not only the fun and spirit of the golf game, but more importantly reduce the overall playing cost for the game to the point that almost anybody can afford playing it. A special ball which is similar to the regular soccer ball, but behaves totally differently when kicked or passed, is used to play the game of Sokker Golph™. The so-called skokker (short for "Skokker Ball™"), which is the subject of the current invention, exhibits an eccentric and rather uncontrollable motion in flight when kicked or on the ground when putted unless a concomitant spin is properly applied to it. In other words, the skokker allows properly trained players to control its motion on the ground and in the air. Once this is achieved, skilled soccer players can continue to use their ball handling skills in kicking and moving the skokker while playing the game of Sokker Golph™.

THE PRIOR ART

Dating back as far as one can remember, it has been almost an unexplainable action for people to kick something that is lying on the ground. It is especially so when the object happens to be a ball. Thus, over the past several decades, various ideas have been advocated via the patent avenue to improve one's skill in kicking the ball, or to improve the features of the ball itself, so that people can derive more pleasure, fun or satisfaction while kicking it. This, of course, is above and beyond people's appetite and strong desire to play or watch all kinds of sporting games involving the use of a ball from as small as the golf ball in golf to the elongated shaped football in American football, soccer ball in the game of soccer and basketball in the game of basketball. The only exception is the game of ice or field hockey when a disc called a "puck" is used instead of a ball.

In U.S. Pat. No. 1,668,143 issued to Daasch in 1928, the inventor advances a novel type of sounding toy in the form of a hollow ball having a sound producing member disposed therein so that when the ball is placed in motion, an intermittent sound will be pronounced and emitted from the ball. The object is to amuse small children and arouse their exciting curiosity when they play with the ball of this invention.

In U.S. Pat. No. 2,499,483 issued to Foy in 1950, the author invented a rolling, audible and visual toy, comprising a hollow thin sphere formed of transparent plastic material, a flat thin metal double-faced mirror arranged within the sphere and extending diametrically of the same and having its marginal edge attached to the sphere, and colored balls arranged within the sphere upon opposite sides of the mirror. This invention relates to toys for infants.

In U.S. Pat. No. 3,370,851 issued to Murray in 1968, an art of kicking a football was introduced. This invention advances a provision in a football of means visible to the kicker during the process of kicking the ball for insuring its correct orientation relatively to the kicking foot for obtaining uniformly accurate results for each of the different types of kicks. The official rules of NCAA define the ball used in the game of football as having the shape of a prolate spheroid and it is due to this shape of the ball it has been quite difficult to master the art of producing accurately directed and properly executed so-called "end-over-end" and "spiral" punts. These punts are those which the football rules define as being a kick by the player who drops it from his hands and kicks it before it strikes the ground. This invention advances three sets of clearly delineated, visible guide marks formed on the laced top of the ball in order to allow the kicker to apply the correct spin on the ball for achieving the best results.

In U.S. Pat. No. 5,000,451 issued to Macdonald et al. in 1991, the authors disclosed a game football which can be stabilized in flight by weighted material that responds to spinning of the football about its major axis by moving radially outwards to become evenly distributed about that axis. Two annular tubes, concentrically disposed about the major axis encircle the ball at opposite sides of a plane containing the minor axis of the ball. The weighted material, in the form of beads, liquid, etc. is contained within the tubes and is flung radially outward as the ball spins.

In U.S. Pat. No. 5,219,162 issued to Orbanes et al. in 1993, the inventors advanced a toy ball having a body of solid foam plastic material and a noisemaker completely embedded within the foam plastic body. The noise maker includes a hollow rigid housing made out of plastic and a marble within the housing free to roll around therein so as to create a clattering sound when the ball is shaken, thrown or caught.

In U.S. Pat. No. 5,947,845 issued to Canelas in 1999, the inventor advances a combination of a pair of soccer shoes and a soccer ball wherein each of the shoes and the ball have an exterior surface marked with selected areas of differing shapes and colors. The markings on the shoes correspond in shape and color to the markings on the exterior of the ball in order to instruct a kicker where to kick the ball with each portion of his or her foot in order to make the ball move in desired directions.

In U.S. Pat. No. 6,056,622 issued to Chung in 2000, unpredictable bounce characteristics are imparted to a ball by forming the ball as a composite wherein a second ball part is disposed within a first ball part with the centers of each ball part spaced one from the other. Such an unpredictable motion of the ball upon kicking by the player serves to add more fun to the playing with the ball. In a first embodiment of this invention, the second part is of the relatively high bounce ball type that is disposed in an off-center cavity formed in the first ball part which is fabricated from sponge-like rubber. In a second embodiment the first ball part is of the relatively high bounce ball type and the second ball part is an air filled cavity spaced from the center of the first ball part. The manner in which this composite ball can be fabricated in practice is also disclosed.

In U.S. Pat. No. 6,398,616 B1 issued to Motosko, III in 2002, the inventor advanced an inflated ball comprising an outer chamber formed of an air-tight flexible outer skin which, when properly inflated and fully expanded, defines an interior volume. A sealed inner chamber filled with a substance substantially heavier than air is positioned within and occupies a relatively small amount of the interior volume. A plurality of elongated radially extending and three-dimensionally spaced elastic members are each connected and radially extended between the inner chamber and the inner surface of the outer chamber. The elastic members are cooperatively sized in length and suitably tensioned to support and hold the inner chamber centrally in an at-rest position within the interior volume. Each of the elastic members will cooperatively stretch and contact in response to ball movement, such as rolling or being thrown and impact of the ball against a surface, causing the inner chamber to be unpredictably displaced from the at-rest position by gravity and inertia resulting in erratic movement of the ball.

In a follow-on U.S. Pat. No. 6,537,125 B1 issued also to Motosko III in 2003, a hand grip molded with and radially extending from the outer skin is added so as to enhance sitting and bouncing play action.

It is evident from the prior arts described above that the conceptual implementation of a special ball called the skokker which behaves uncontrollably unless it is being handled in a specifically skillful way is absent. Nevertheless such a ball is crucial to the success of the sporting game of Sokker Golff, the subject of an earlier provisional patent application disclosed and specifically incorporated herein by reference.

SUMMARY OF THE INVENTION

The present invention is generally directed to a game ball having a hollow inner core partially filled with a fluid, a ball shell with outer and inner surfaces and struts with a first end attached to the core and their other end connected to inner surface of the ball in such a way so as to maintain the core at the center of the ball (e.g., six struts having six points in two perpendicular planes such that each of the two planes will contain four of the six attachment and connection points).

In a separate group of aspects of the present invention, a swirling motion of the fluid within the hollow inner core determines the motion of the ball and a direction of travel away from a point of contact at which a force is applied to the ball to cause it to move or change direction. The direction of travel of the ball will be to the right when a counterclockwise spin is applied to the ball at the point of contact, the direction of travel of the ball will be to the left when it a clockwise spin is applied to the ball at the point of contact, and the direction of travel of the ball will be straight when a top spin is applied to ball at the point of contact.

In another separate group of aspects of the present invention, the six struts support the core in such a way so as to maintain the core at the center of the ball and the inner core is formed out of a hard plastic material while fluid (which can include metallic spheres) fills approximately 50% or less of an inner core volume, the remaining volume being filled with a gas, and the weight ratio of the fluid to the ball without the fluid is approximately 1:1 or greater.

In still other another separate group of aspects of the present invention, each of the struts has a spring located between its first and second ends with an elastic flap at the second end, and the ball has an inflation valve affixed to the ball shell for inflating an air pocket located between the inner surface of the ball shell and the hollow inner core to a preselected pressure (e.g., 6 psi) and the diameter of the ball shell, when the ball is inflated to the preselected pressure, is approximately nine inches.

In a further, separate group of aspects of the present invention, the ball is made by forming a long slit in the ball shell, inserting the inner core with fluid into the interior of the ball shell through the long slit, and sequentially attaching the plurality of struts to the inner core, each of the struts being inserted through the long slit and then extended to a final position, and then sealing the long slit.

Accordingly, it is a primary object of the present invention to provide a novel ball that exhibits eccentric rolling and flight characteristics that allow it to be used in new ways and for new games.

This and further objects and advantages will be apparent to those skilled in the art in connection with the drawings and the detailed description of the preferred embodiment set forth below.

DETAILED DESCRIPTION OF THE INVENTION

Figure 1:
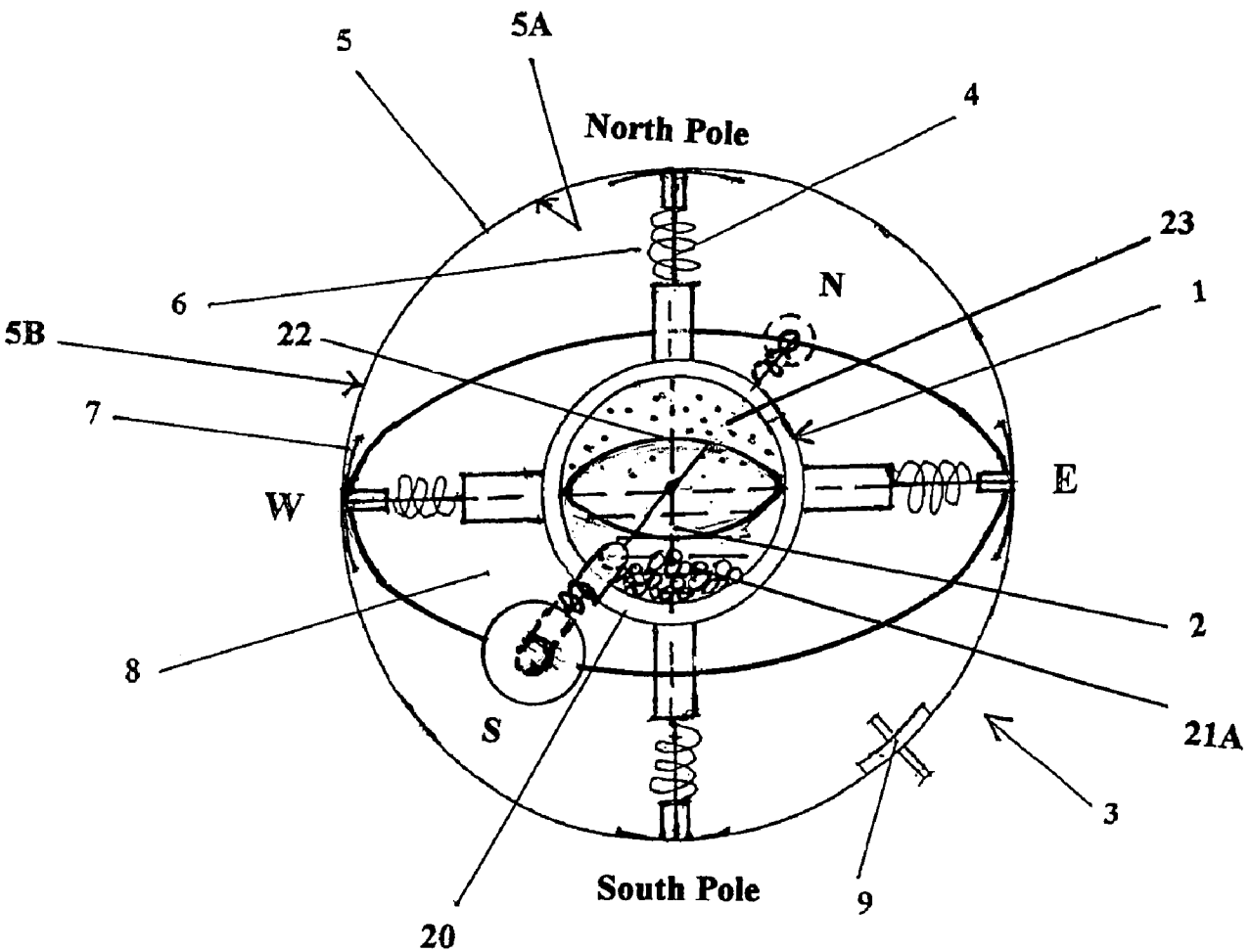
FIG. 1 depicts the schematic layout for the design of a preferred embodiment of a skokker ball showing the construct of a hollow inner core partially filled with a fluid. The inner core is supported with six strategically located protruding struts against the outer wall of the skokker in such a way so as to always maintain the core at the center of the skokker.

The present invention will now be discussed in connection with a preferred embodiment shown in FIGS. 1-8.

In the Figures and the following more detailed description, numerals indicate various features of the invention, with like numerals referring to like features throughout both the drawings and the description. Although the Figures are described in greater detail below, the following is a glossary of the elements identified in the Figures.

| | |
|---|---|
| 1 | inner core |
| 1A | attachment points to the core |
| 2 | fluid |
| 3 | game ball |
| 4 | strut |
| 4A | strut bore |
| 4B | strut shaft |
| 4C | strut thread |
| 5 | ball shell |
| 5A | inner surface of ball shell 5 |
| 5B | outer surface of ball shell 5 |
| 6 | spring |
| 7 | elastic flap |
| 8 | air pocket |
| 9 | inflation valve |
| 10 | counterclockwise spin |
| 11 | right side point of contact |
| 12 | clockwise spin |
| 14 | left side point of contact |
| 20 | hard plastic shell of inner core 1 |
| 21 | fluid |
| 21A | optional spheres included as part of fluid 21 (as opposed to gas 23) |
| 22 | sealed spherical cavity |
| 23 | gas inside cavity 22 |
| 111 | slit |

The present invention is directed to a novel ball called "The Skokker Ball™" ("skokker" for short) used to play a new outdoor sporting game that combines the intrigue, skill and excitement features of the prestigious golf game with the popular soccer game. This new outdoor sporting game is called "Sokker Golph™". The playing rules of this new game generally follow the framework of golf in that each player starts out with his or her own ball (equivalent to the golf ball in the game of golf) and attempts to place the ball into a designated spot called the "buc" or bucket on the "smooth" (equivalent respectively to the hole and the putting green for the game of golf. The playing field for the game of Sokker Golph is called a "SG course" which is equivalent to the golf course in golf. Like in the playing of golf, when a player using special clubs attempts to sink a golf ball into each of the 9 or 18 holes on a golf course with as few strokes as possible, the player playing Sokker Golph tries to achieve the same objective without the use of clubs but with a totally different ball called the skokker. For playing a "buc" in Sokker Golph a player, optionally equipped with a special pair of shoes, attempts to first kick the ball onto the "smooth" and then sinks the ball into the "buc". Like golf, for playing a 9-buc or 18-buc game, whosoever uses the fewest strokes (kicks or strikes) to sink the skokker into each of the 9 bucs or 18 bucs wins the game.

Unlike the small golf ball used to play golf, the skokker is considerably bigger (~9.0" in diameter) and is slightly bigger than the regular soccer ball which is ~8.5" in diameter. For this reason, the size of the buc on the smooth (~15" in diameter) is also considerably larger than the size of the hole on the putting green for golf. Apart from the size difference of the skokker from either the golf ball or the soccer ball, the construct of the skokker is totally different as depicted in FIG. 1.

As shown in FIG. 1, the skokker game ball 3 has a centrally located hollow spherical shell or inner core 1 formed out of a hard plastic material 20 which is filled in part by a fluid (liquid) 2 which is much heavier than air. Possible candidates for the filling fluid 2 include glycerin, oils such as motor or olive oil, or water.

The hollow spherical shell or inner core 1 is supported at the center of skokker game ball 3 by six protruding struts 4 with four of the six struts located at the equatorial directions of East, South, West and North and the other two pointing at the North and South Pole position respectively as portrayed in FIG. 1. This arrangements allows the points of contact of each of the six struts with inner core 1 and inner surface 5A of ball shell 5 to be uniquely defined by two planes that perpendicularly intersect each other such that each of the two planes will contain four of the six attachment points with inner core 1 and four of the six connection points with inner surface 5A. Each of the six protruding struts 4 presses against an inner surface 5A of an outer ball shell 5 of skokker ball 3 though a stiff spring 6 and an elastic flap 7. It is through the specially designed springing action of struts 4 exerting equal and constant pressure at inner core 1 that the latter is kept always at the center of skokker ball 3, even when the latter is being kicked or struck. Meanwhile the space or air pocket 8 between inner core 1 and the inside surface of ball shell 5 is filled with compressed air whose pressure is controlled by letting air in or out of a built-in inflation valve 9. When skokker ball 3 is properly inflated, its pressure is ~6 psi and the diameter of skokker ball 3 is approximately 9.0".

In order for inner core 1 with its fluid 2 in motion to control the resultant motion of skokker ball 3, either on the ground or in flight, the weight distribution between inner core 1 and its fluid 2 and the rest of the skokker ball 3 must be designed to have at least a 1:1 ratio. Another factor that must be taken into consideration is the overall weight of skokker ball 3 which ideally should not be heavier than about one pound, or the weight of a regular soccer ball. Because of this consideration, the size of inner core 1 is optimally set, in an especially preferred embodiment used for Sokker Golph™, at ~3.0" in diameter.

One way to increase the weight distribution is to increase the volume of fluid 2 that inner core 1 contains. This is because the density of fluid 2 is much greater than that of air and supporting struts 4 of skokker ball 3. However, as more and more fluid is put inside the sealed spherical cavity 22 of inner core 1 so that it exceeds ~50% of the internal volume of cavity 22, the motion of fluid 2 inside cavity 22 will also be constrained, thereby effectively decreasing the influence of fluid 2 on the resultant motion of skokker ball 3. The amount of fluid 2 contained inside cavity 22 can be a small fraction of the internal volume of cavity 22 up to ~50% of it. Since the density of air is ~0.0012 gm/cc and the density of fluid 2 (oil or water) is ~1.0 gm/cc, for a 9.0" diameter skokker ball 3 with a 3.0" diameter inner core 1, when cavity 22 is filled with ~50% of its volume with fluid 2, the weight ratio of fluid 2 to ball shell 5 plus struts 4 (plus compressed air in air pocket 8) can be adjusted to be close to the desired 1:1 ratio. Such a structure for skokker ball 3 with fluid 2 in cavity 22 of inner core 1 dominating its motion is critical to the current invention.

A weight ratio of greater than 1:1 can be achieved by replacing some of the volume of fluid 2 in cavity 22 of inner core 1 with tiny metallic spheres 21A of the order of 1 mm diameter made of a metal, such as, for example, steel, brass or copper. (Although such spheres are solid and thus not within the normal definition of a "fluid," when such spheres are added to fluid 2 they are deemed to be part of fluid 2 for purposes of the description of the present invention because they increase the density and weight of fluid 2 relative to gas 23 that occupies the remaining volume of cavity 22 and they still allow fluid 2 to maintain its same functional characteristics with respect to the motion of skokker ball 3 and its direction of travel of travel when a force is applied to it to move it or change its direction of travel, as will be described later herein.) Thus, for example, if one were to use steel spheres with a density ~7.8 gm/cc to displace 25% of the fluid volume while still maintaining cavity 22 half-filled with fluid by volume and half filled with air by volume, the weight ratio of fluid 2 (including steel spheres) to that of ball shell 5 and struts 4 (plus compressed air in air pocket 8) could be significantly increased to 3:1. There is no doubt that causing fluid 2 to have such a high weight ratio will have a significant effect on the motion of skokker ball 3; however, the overall weight of skokker ball 3 might in this case be too excessive. The current invention allows a preselected desired weight ratio to be designed into skokker ball 3 according to a designer's particular wishes, which also adds the option of changing the characteristics of skokker ball 3 for differing situations and applications, or even for games other than Skokker Golph™, as well as for creating skokker balls of different sizes for differing applications. (Thus, for example, one might design a skokker ball 3 for use instead of a volleyball or a kickball, and one could also design other games, or modify existing games, to take advantage of the unique characteristics obtainable by use of a skokker ball, or a skokker ball of a different size or diameter).

Because of its special ball design, skokker ball 3 behaves very differently from a regular soccer ball or any other ordinary ball upon either being kicked or struck (putted). This difference in behavior is attributed to movement of fluid 2 that partially occupies cavity 22 of inner core 1 of skokker ball 3 (see FIG. 1) upon being kicked or struck. Thus, unlike kicking the soccer ball whose direction of travel depends primarily upon the kicker's aim and optional spin, the travel direction of a skokker ball 3 is simply unpredictable unless it is being kicked or struck in a special fashion or manner as explained below.

Figure 2:
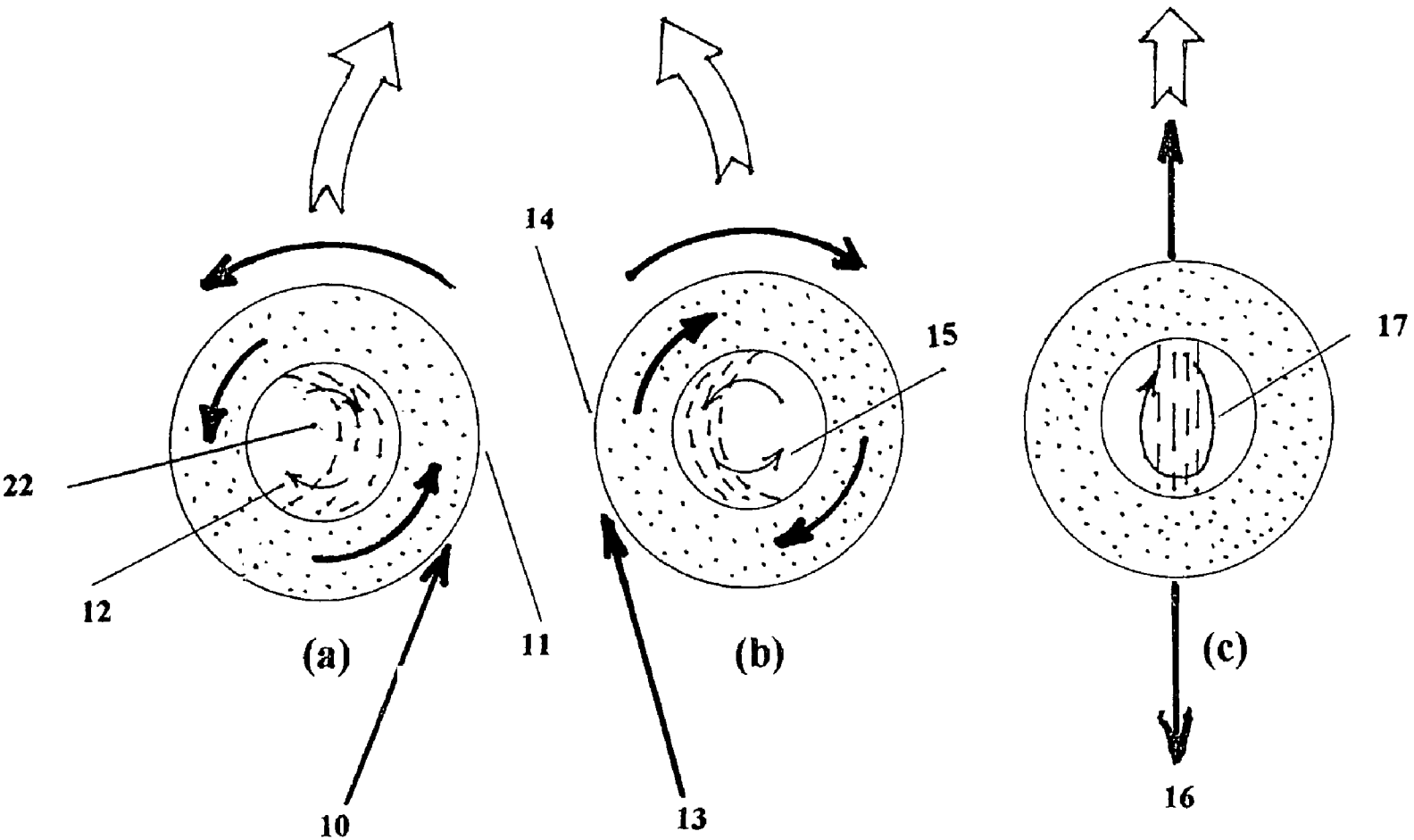
FIG. 2 depicts the directional motion of the skokker when a spin is concomitantly applied to the a) right side of the skokker; b) the left side of the skokker and c) the top surface of the skokker with the kicking.

To determine the travel direction of skokker ball 3 upon either being kicked or struck (putted), a spin must be imparted onto the ball in order to control the motion of fluid 2 in inner core 1 of skokker ball 3. In other words, the spin imparted onto skokker ball 3 will cause fluid 2 inside cavity 22 of core 1 at the center of skokker ball 3 to swirl substantially in a well-defined manner such as a clockwise, counterclockwise, top to bottom or bottom to top spinning direction as depicted in FIG. 2. It is this swirling motion of the fluid at the core of skokker ball 3 that will determine the motion of skokker ball 3 and its subsequent direction of travel. In other words, unless skokker ball 3 is kicked or struck in a deliberate fashion, skokker ball 3 will appear to have a mind of its own upon being casually kicked or struck and will travel in a totally uncontrollable and unpredictable manner.

As shown in FIG. 2(*a*), when a counterclockwise spin 10 is applied to a right side point of contact 11 of skokker ball 3 while it is being kicked or struck, an equivalent clockwise spinning effect 12 is imparted to fluid 2 inside cavity 22 thus causing the resultant motion of skokker ball 3 to the right from the point of contact. When a clockwise spin 13 is applied to a left side point of contact 14 of skokker ball 3 while it is being kicked as shown in FIG. 2(*b*), an equivalent counterclockwise spinning effect 15 is imparted to fluid 2 inside cavity 22 thus causing the resultant motion of the ball to the left. In FIG. 2(*c*) when a top spin 16 is imparted to the ball while it is kicked, the effective spinning on fluid 2 inside cavity 22 remains in the vertical plane 17 and the skokker ball 3 will subsequently go in a straight direction without swirling to the left or right. The examples given above are for pure spin actions. In actuality this seldom happens and the spin imparted to skokker ball 3 by the kicker is some kind of a mixture of spin actions illustrated in FIG. 2. Nevertheless, it is possible to control the directional motion of skokker ball 3 in flight or on the ground by applying a deliberate and appropriate spin to it while kicking or striking (putting) same. In one extreme situation, skokker ball 3 can be made to behave like a boomerang that will come back right at the kicker after it is appropriately kicked. However, it would take a lot of practice before one can achieve such a feat.

Thus, unlike many balls advanced earlier that produce fun by erratic and uncontrollable movements or making random clattering sounds, the skokker is unique in that its motion in flight or on the ground is totally controllable by the player. However, a player must learn, through a lot of training and hard work, to control its directional motion. Such is desirable if the skokker is to be used for the game of Sokker Golph. This is because a sporting game has hardly any meaning in playing if everything about playing it is pretty much left to luck or accidental happenings. The game of golf will never be the same if there is no control of driving or putting the ball through a lot of hard work and practice. Similarly, the game of soccer is not the same game if the ball cannot be skillfully controlled by the players but is left only to random and unpredictable motion.

Although the design concept of the present invention, namely, the skokker ball, has been described in relatively straightforward terms herein, its fabrication and ultimate production with its designed construct as described above is not simple at all. Conventional techniques of producing balls of all types with the use of an elastic inner "tube" or shell cannot be applied to the fabrication of the presently invented skokker. The reason is that it is very difficult and almost impossible to include the inner core (with fluid) and its supporting structure into the elastic inner shell due to the high temperature used in the molding of same. The same difficulties apply to making the skokker with the method of making beach balls without an elastic inner shell or tube. However, the technique of making foam balls to include just the inner core of the skokker without its supporting struts is feasible. Unfortunately such a construct makes the weight ratio between inner core to the outer part of the skokker much less than 1:1. The attempt to increase the weight of the inner core with metallic spheres replacing most of the fluid does not work effectively because the overall weight of the skokker will be much heavier than one pound. Furthermore, the foam construct of the skokker will not always hold the inner core truthfully to the center of the skokker as the foam materials act like a large number of springs connected to the inner core. As the skokker is being kicked or struck, each foam element will react differently leading to an uneven force acting on the inner core thereby randomly displacing it from the true center of the skokker.

A special assembly technique has been devised to fabricate the presently invented skokker as depicted in FIGS. 3-8.

Figure 3:
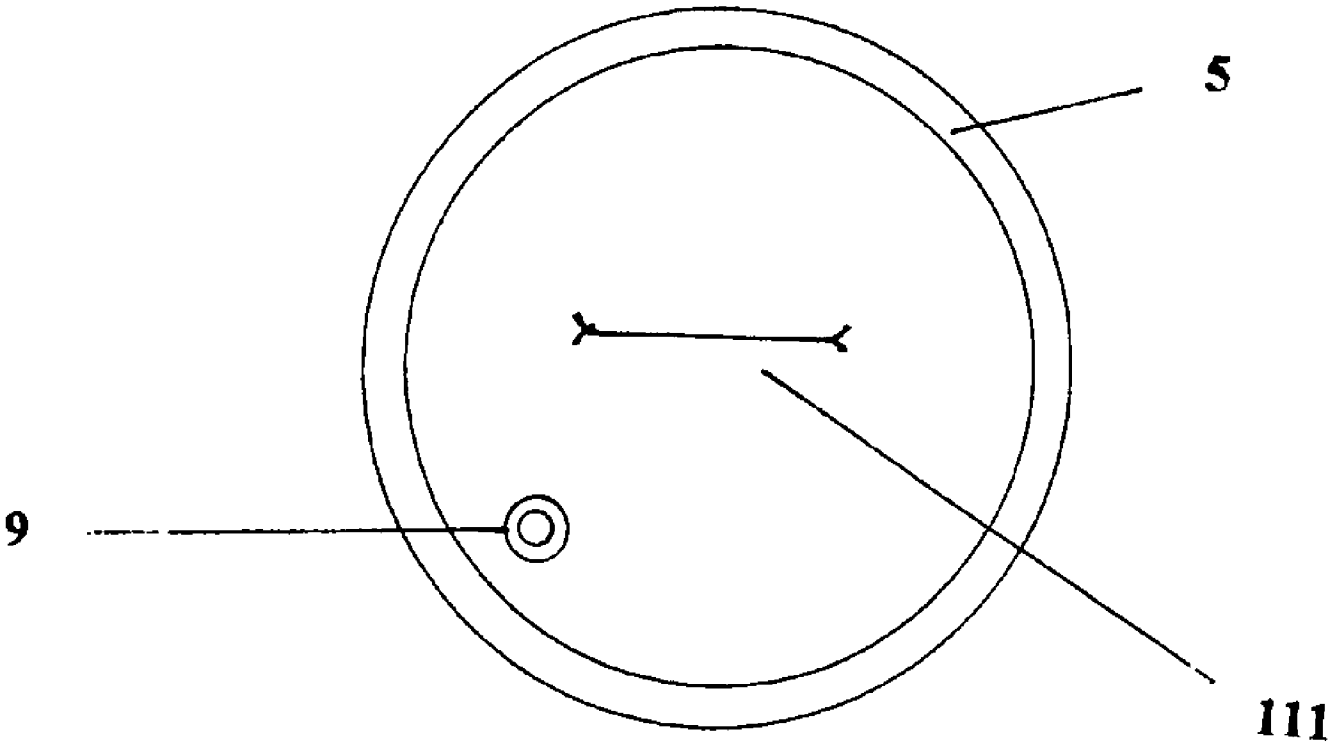
FIG. 3 depicts a 4" slit cut on the surface of a beach ball made out of high quality rubber and without an inner shell or tube in its construction.
Figure 4:
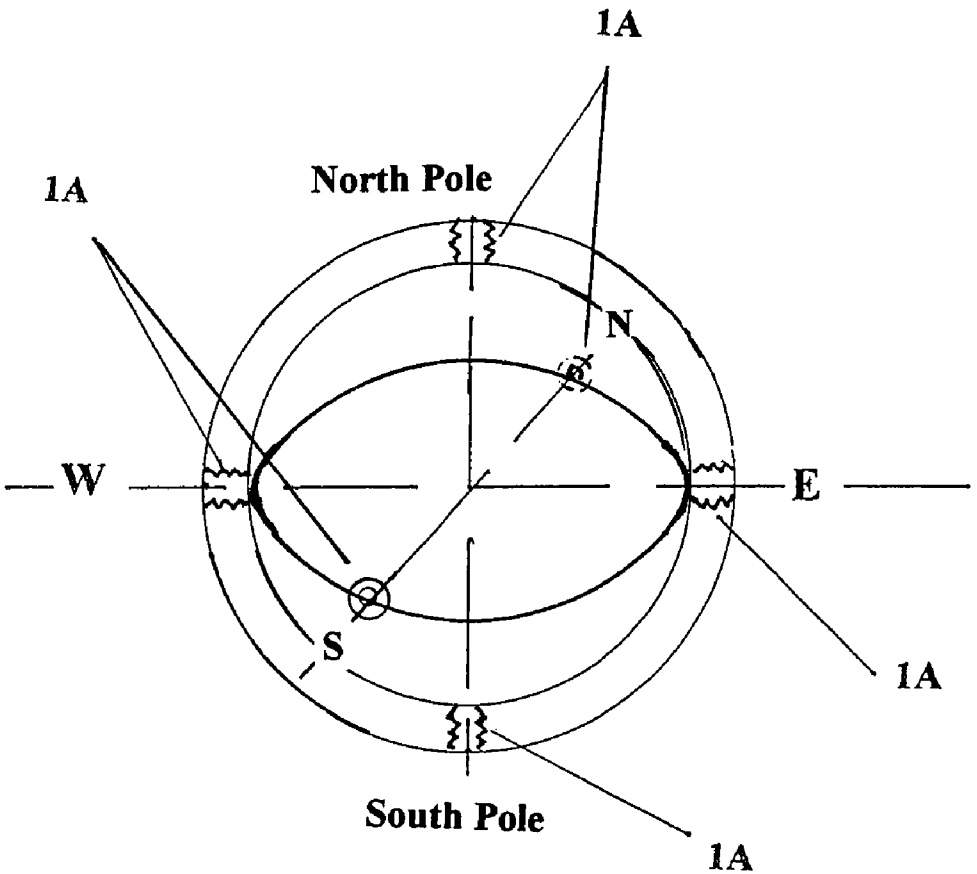
FIG. 4 depicts a special inner core made out of hard plastic material such as polycarbonate with a wall thickness of 0.125" having six reinforced #10-32 threaded holes cut through its surface corresponding to the equatorial East, South, West and North directional locations plus the North and South Pole positions.
Figure 5:
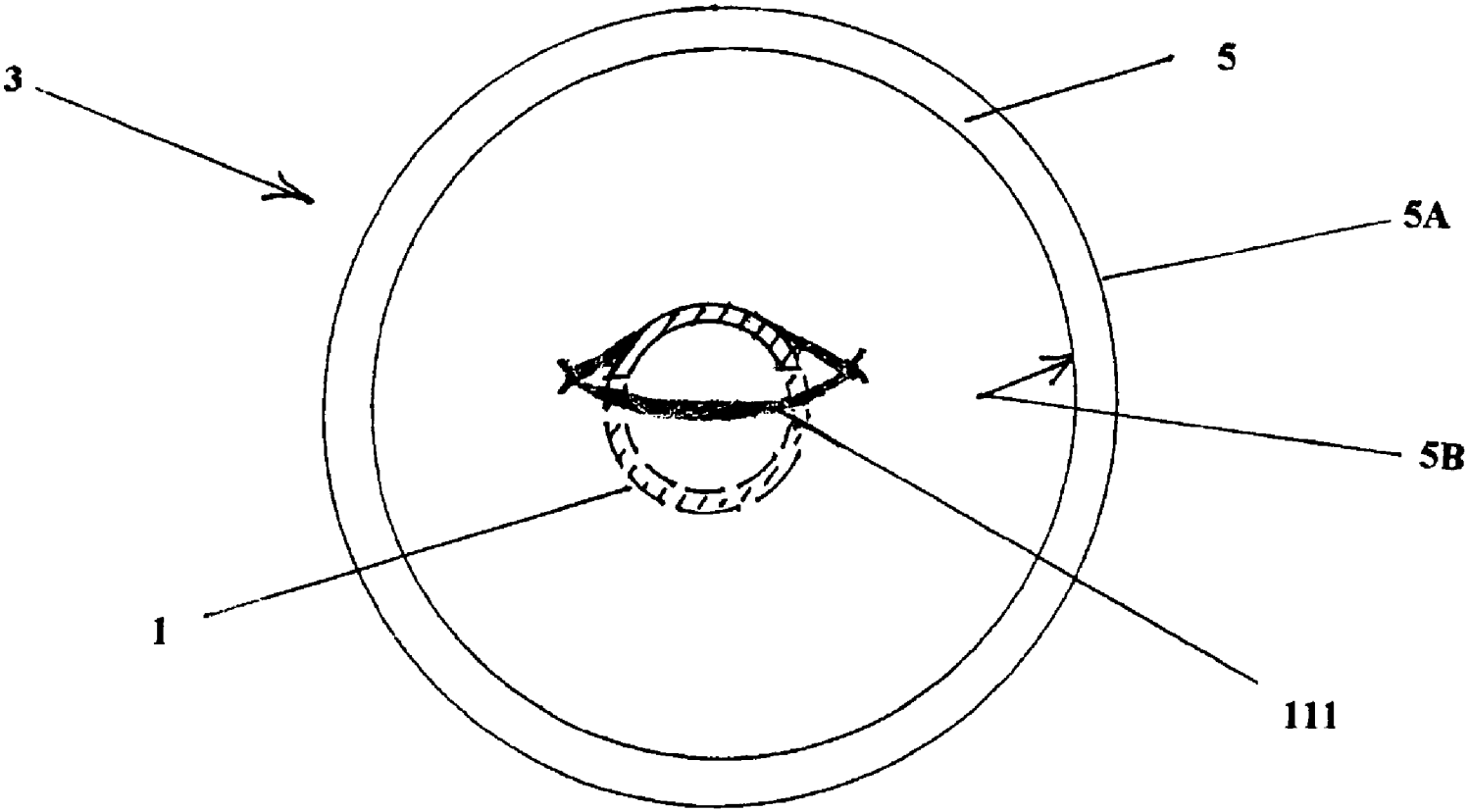
FIG. 5 illustrates how the 3.0" diameter inner core is gently being inserted into the skokker through the 4.0" slit cut earlier on the surface of the skokker.

Starting out with a high quality beach ball made out of rubber and equipped with an air valve for inflating or deflating the ball, a 4" long slit 111 is cut in ball shell 5 as shown in FIG. 3. A special inner core or hollow spherical shell with an 0.125" wall thickness is made out of hard plastic such as polycarbonate and equipped with six reinforced #10-32 threaded holes 1A on its surface corresponding to the equatorial East, South, West and North directional locations plus the North and South Pole positions as shown in FIG. 4. The inner core is then gently pushed into the rubber beach ball through the 4" slit 111 opening as shown in FIG. 5.

Figure 6:
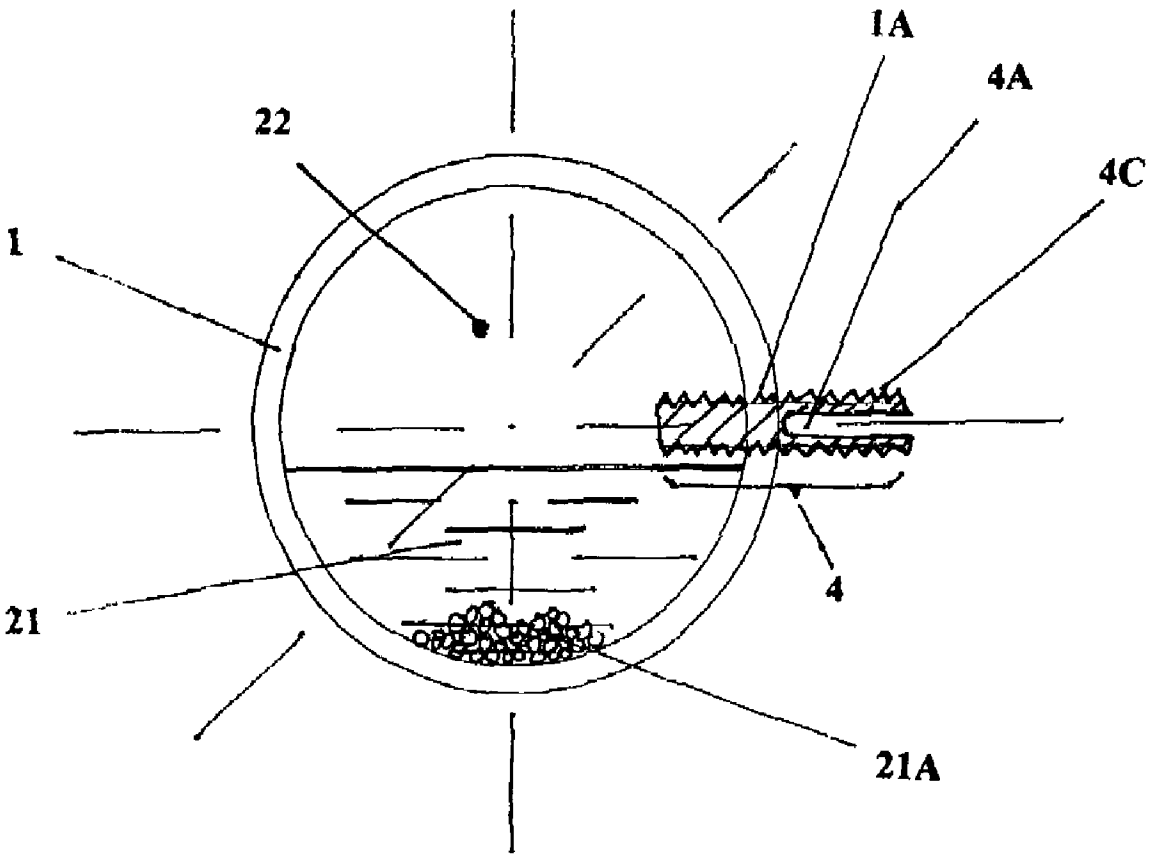
FIG. 6 illustrates the installation of a specially threaded strut into a threaded hole on the surface of the inner core.

Six specially threaded struts 4 (#10-32) 1.875" long with a 0.094" diameter bore 4A at one end are attached to inner core 1 by screwing them respectively into all six threaded holes 1A with the bore end facing outwards approximately 0.75" into the core as shown in FIG. 6. This is done through the 4" slit 111 while the inner core is inside the skokker. It is at this point in the construction that the right amount of fluid 21 (plus optional metallic spheres 21A) is injected into inner cavity 22 through a small bore (not shown) and sealed. Note that the threaded holes 1A on the surface of the inner bore with the installation of the threaded struts do not allow any serious leaks to take place during the construction. However, these threaded holes have to be permanently sealed after the struts are extended (see below).

Figure 7:
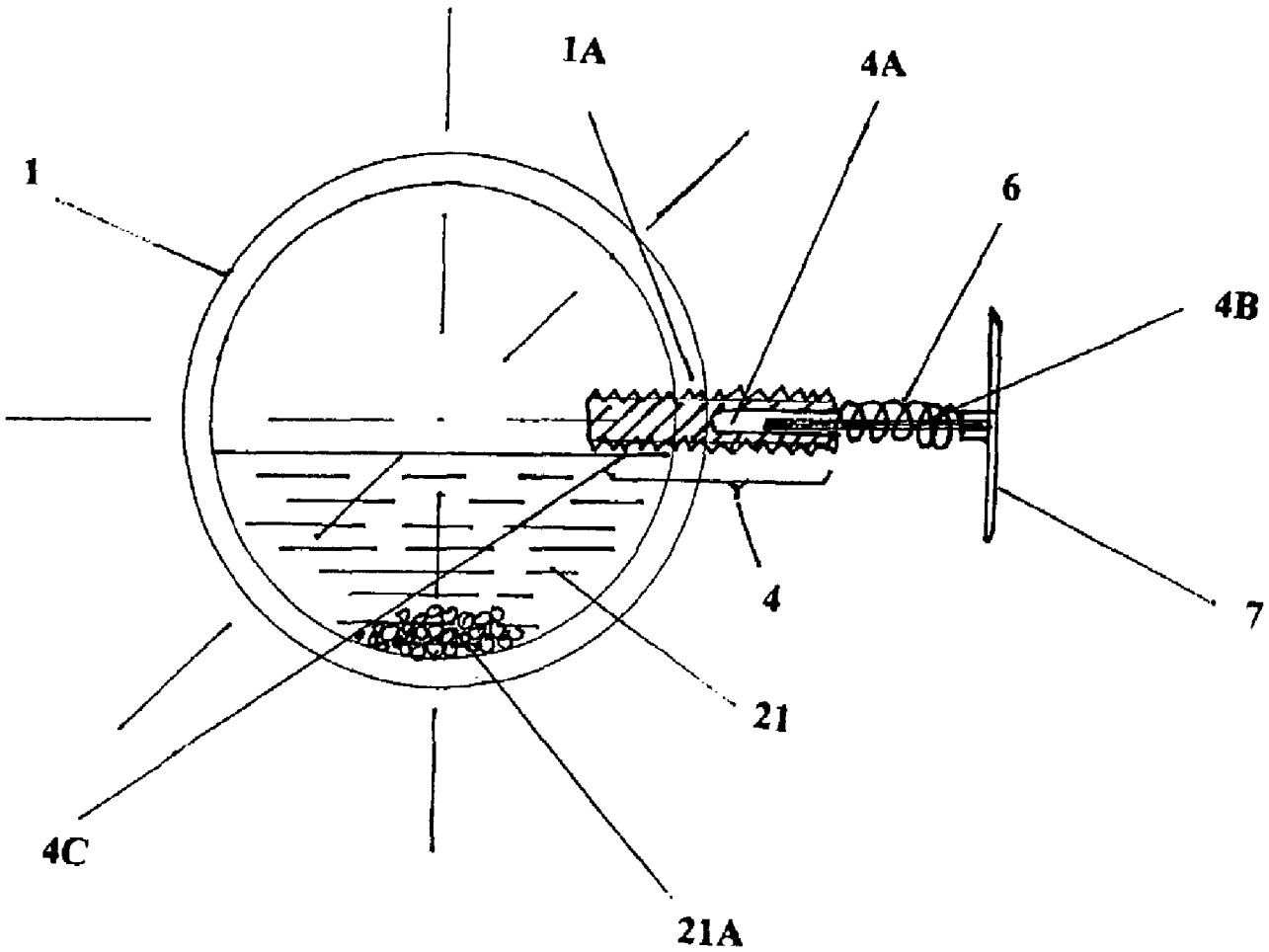
FIG. 7 illustrates the insertion of an elastic flap outfitted with a spring and steel shaft into a strut already attached to the inner core through a 0.094" diameter bore in the strut.

An elastic flap 7 made of Delrin® (with optional plastic foam) and supported centrally by a 0.094" diameter steel shaft 4B with a ~1" spring 6 is then inserted into each of the six 0.094" diameter bore holes of the struts as shown in FIG. 7. Again, this is done through the 4.0" slit 111 while inner core 1 is inside the skokker.

Figure 8:
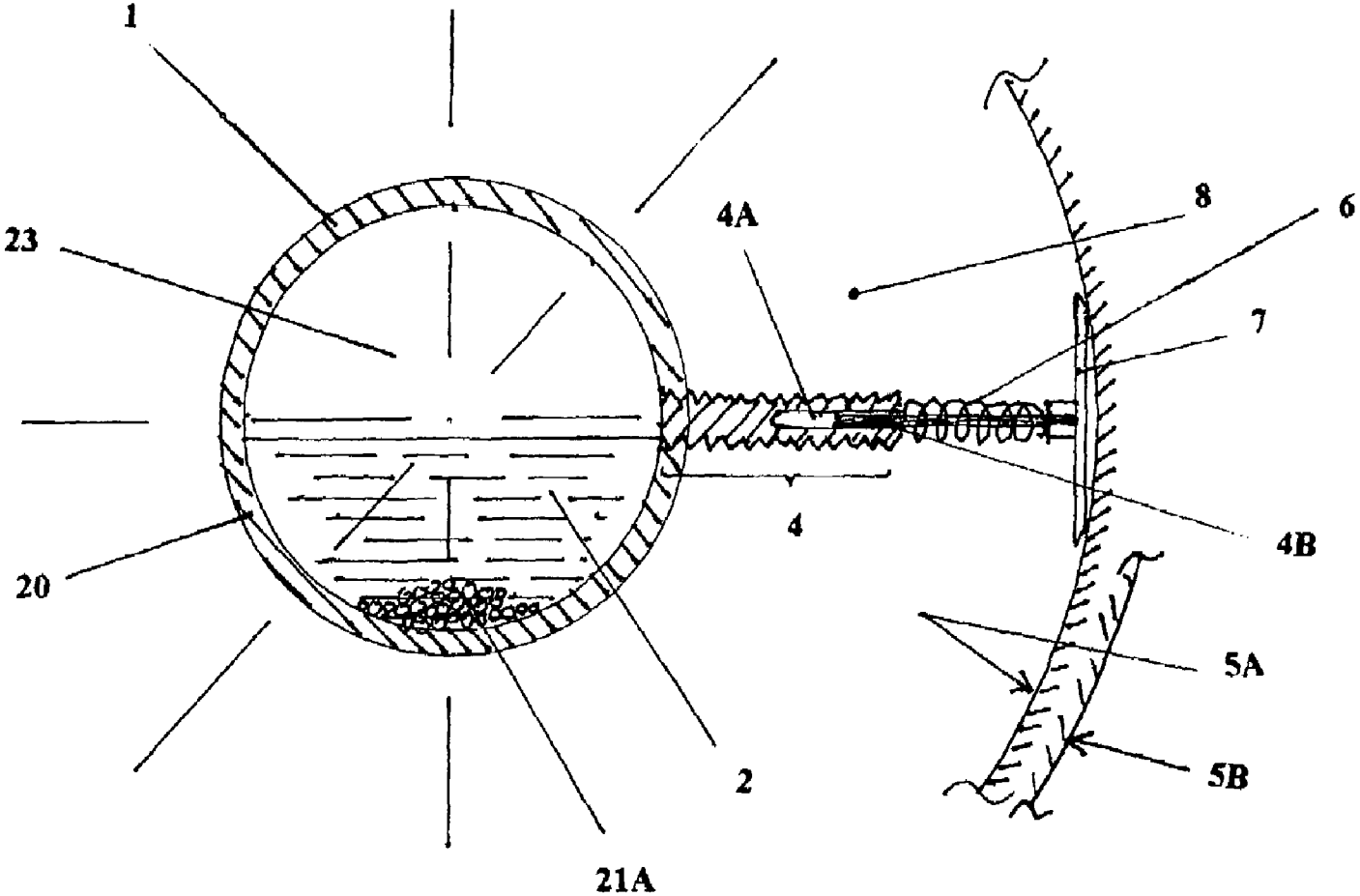
FIG. 8 shows the final positions of a strut inside the skokker after the six struts are extended ~0.75" from the inner core surface allowing the plastic flaps to press snugly against the inner surface of the ball shell of the skokker.

After all six struts are attached to inner core 1 inside the skokker, each of the six threaded struts 4 is extended outside of the inner core by turning the #10-32 thread 4C from the threaded hole 1A of inner core 1 inside the skokker. This is done when the strut is extended an additional ~0.75" from the inner core surface thereby allowing the spring-loaded flap 7 to press against the inner surface of ball shell 5 of the skokker as illustrated in FIG. 8. The 4" slit is then glued back together using a specially formulated rubberized sealant Flexane® 80 liquid resin and curing agent after applying the FL-20 primer to the roughened surface. After the 4" slit is appropriately sealed, the skokker can be inflated to ~6 psi pressure (~9.0" in diameter) and its outer surface 5B can then be optionally decorated if desired. After that is done, the skokker is ready for play.

Thus, there has been described above the salient features of an embodiment for the skokker which is the ball used to play the sporting game "Sokker Golph". While the invention has been described herein with reference to certain preferred embodiments, those embodiments have been presented by way of example only, and not to limit the scope of the invention. Additional embodiments thereof will be obvious to those skilled in the art having the benefit of this detailed description. Further modifications are also possible in alternative embodiments without departing from the inventive concept. For example, the motion of the skokker and its direction of travel away from a point of contact might be altered by using a core cavity of a shape different than a sphere. Also, the skokker might use more than six struts (six struts is the minimum number of struts needed to retain a spherical core at the center of the skokker). In addition, the skokker might be made by different methods, such as using a sealed inner core with a predetermined amount of liquid that is inserted inside of the ball shell during construction, while the struts might not be threaded all the way through the hollow inner core.

Accordingly, it will be apparent to those skilled in the art that still further changes and modifications in the actual concepts described herein can readily be made without departing from the spirit and scope of the disclosed inventions as defined by the following claims.

What is claimed is:

1. A game ball, comprising:

a hollow inner core partially filled with a liquid fluid;

a ball shell having an outer surface and an inner surface; and six struts, each of said struts having a first end attached to the core and a second end connected to inner surface of the ball;

wherein the six struts are attached to the core at six attachment points and connected to the ball shell at six connection points in two perpendicular planes such that each of the two planes will contain four of said six attachment and connection points.

2. The ball of claim 1, wherein a swirling motion of the fluid within the hollow inner core determines the motion of the ball and a direction of travel away from a point of contact at which a force is applied to the ball to cause it to move or change direction.

3. The ball of claim 2, wherein the direction of travel of the ball will be to the right when a counterclockwise spin is applied to the ball at the point of contact, the direction of travel of the ball will be to the left when it a clockwise spin is applied to the ball at the point of contact, and the direction of travel of the ball will be straight when a top spin is applied to ball at the point of contact.

4. The ball of claim 1, wherein the six struts support the core in such a way so as to maintain the core at the center of the ball.

5. The ball of claim 1, wherein the inner core is formed out of a hard plastic material and the fluid fills approximately 50% or less of an inner core volume while the remainder of the inner core volume is filled with a gas.

6. The ball of claim 5, wherein the fluid is further comprised of a plurality of metallic spheres.

7. The ball of claim 5, wherein the weight ratio of the fluid to the ball without the fluid is approximately 1:1 or greater.

8. The ball of claim 1, wherein each of said struts is further comprised of:

a spring located between the first and second ends and an elastic flap at the second end.

9. The ball of claim 8, wherein the ball is further comprised of an inflation valve affixed to the ball shell for inflating an air pocket located between the inner surface of the ball shell and the hollow inner core to a preselected pressure.

10. The ball of claim 9, wherein the preselected pressure is approximately 6 psi and the diameter of the ball shell, when the ball is inflated to the preselected pressure, is approximately nine inches.

11. A game ball, comprising:

a hollow inner core partially filled with a fluid;

a ball shell having an outer surface and an inner surface; and a plurality of struts, each of said struts having a first end attached to the core and a second end connected to inner surface of the ball;

wherein the plurality of struts are attached to the core and connected to the ball shell in such a way so as to maintain the core at the center of the ball; and wherein a swirling motion of the fluid within the hollow inner core determines the motion of the ball and a direction of travel away from a point of contact at which a force is applied to the ball to cause it to move or change direction.

12. The ball of claim 11, wherein the direction of travel of the ball will be to the right when a counterclockwise spin is applied to the ball at the point of contact, the direction of travel of the ball will be to the left when it a clockwise spin is applied to the ball at the point of contact, and the direction of travel of the ball will be straight when a top spin is applied to ball at the point of contact.

13. The ball of claim 12, wherein the ball is further comprised of an inflation valve affixed to the ball shell for inflating an air pocket located between the inner surface of the ball shell and the hollow inner core to a preselected pressure and wherein the fluid fills approximately 50% or less of an inner core volume and the remainder of the inner core volume is filled with a gas.

14. The ball of claim 13, wherein the fluid is further comprised of a plurality of metallic spheres.

15. The ball of claim 14, wherein the weight ratio of the fluid to the ball without the fluid is approximately 1:1 or greater.

16. The ball of claim 15, wherein each of said struts is further comprised of:

a spring located between the first and second ends and an elastic flap at the second end.

17. The ball of claim 16, wherein said ball is made by forming a long slit in the ball shell, inserting the inner core with fluid into the interior of the ball shell through the long slit, sequentially attaching the plurality of struts to the inner core at a plurality of strut attachment points, each of said struts being inserted through the long slit and extending them to a final position and sealing the long slit.

18. A game ball, comprising:

a core with a sealed spherical cavity filled with a gas and a fluid that can swirl within the cavity;

a ball shell having an outer surface, an inner surface and an inflation valve; and at least six struts, each of said struts being attached to the core at a first end and extending outwardly toward the inner surface of the ball shell at which a second end of the strut contacts said inner surface of the ball shell, the second end of the strut being biased against the inner surface of the ball shell by a spring;

wherein a swirling motion of the fluid within the spherical cavity determines the motion of the ball and a direction of travel away from a point of contact at which a force is applied to the ball to cause it to move or change direction; and wherein the direction of travel of the ball will be to the right when a counterclockwise spin is applied to the ball at the point of contact, the direction of travel of the ball will be to the left when a clockwise spin is applied to the ball at the point of contact, and the direction of travel of the ball will be straight when a top spin is applied to ball at the point of contact.

19. The ball of claim 18, wherein the weight ratio of the fluid to the ball without the fluid is approximately 1:1 or greater.

20. The ball of claim 19, wherein the gas occupies approximately 50% or more of the volume of the sealed spherical cavity.

* * * * *